US006500105B1

(12) United States Patent
Kuo

(10) Patent No.: US 6,500,105 B1
(45) Date of Patent: Dec. 31, 2002

(54) PORTABLE EXERCISING APPARATUS

(76) Inventor: Johnson Kuo, 5F., No. 6, Lane 12, Sec. 6, Hsin I Rd., Taipei (TW)

( * ) Notice: Subject to any disclaimer, the term of this patent is extended or adjusted under 35 U.S.C. 154(b) by 241 days.

(21) Appl. No.: 09/597,563

(22) Filed: Jun. 20, 2000

(51) Int. Cl.[7] ..... A63B 21/055; A63B 21/04

(52) U.S. Cl. ..... 482/123; 482/125; 482/126; 482/132; 482/95; 482/910

(58) Field of Search ..... 482/122–126, 482/129, 132, 95, 96, 141, 907, 910

(56) References Cited

U.S. PATENT DOCUMENTS 1,984,165 A * 12/1934 Tolchin ..... 482/132
2,129,262 A * 9/1938 Cole ..... 482/132
2,131,570 A * 9/1938 Riley ..... 482/127
2,224,445 A * 12/1940 Parker ..... 482/123
3,460,829 A * 8/1969 Roggero ..... 482/126
3,636,946 A * 1/1972 Hardy ..... 482/123
3,664,667 A * 5/1972 McCarthy ..... 482/126
3,815,904 A * 6/1974 Weiss et al. ..... 482/123
4,225,132 A * 9/1980 Archambault ..... 482/125
5,261,866 A * 11/1993 Mattox ..... 482/125
5,499,961 A * 3/1996 Mattox ..... 482/123
6,071,217 A * 6/2000 Barnett ..... 482/122
6,203,476 B1 * 3/2001 Wang et al. ..... 482/123

* cited by examiner

*Primary Examiner*—Jerome W. Donnelly
*Assistant Examiner*—Victor Hwang
(74) *Attorney, Agent, or Firm*—Varndell & Varndell, PLLC

(57) ABSTRACT

A portable exercising apparatus includes a chest-expander, two rod members adapted for fastening to two handles at two distal ends of the chest-expander for vertical pulling exercises, two wheels adapted for mounting on one rod member for back and forth body extending exercises on the floor, and a bag adapted for holding parts of the exercising apparatus when the exercising apparatus is not in use or fastening to the other handle of the chest-expander to hold a pad to support the knees on the floor when performing back and forth body extending exercises.

1 Claim, 15 Drawing Sheets

PORTABLE EXERCISING APPARATUS

BACKGROUND AND SUMMARY OF THE INVENTION

The present invention relates to exercising apparatus, and more particularly to a portable exercising apparatus that can be detached and then received in a carrying bag when not in use.

A variety of handy exercising apparatus, including chest-expander, hand-muscle developer, etc., have been disclosed, and have appeared on the market. FIG. 1 shows a conventional chest-expander for developing the muscles of the chest. This structure of chest-developer 8 is generally comprised of two handles 81, and a plurality of elastic cord members 80 connected between the handles 81. This structure of chest-developer is inexpensive and functional. However, exercising the body with this structure of chest-developer for a long period of time is quite boring because this structure of chest-developer provides only one single function.

According to one aspect of the present invention, a portable exercising apparatus includes a chest-expander having two handles and a plurality of elastic cord members connected between the handles, two rod members, two wheels, a bag having two barrels longitudinally aligned at one peripheral side, and a pad. When not in use, the chest-expander, one rod member, the wheels and the pad can be received in the bag, and the other rod member can be fastened to the bag on the outside to serve as a carrying handle for carrying by hand. According to another aspect of the present invention, the two rod members can be fastened to the two handles of the chest-expander for vertical pulling exercises. According to still another aspect of the present invention, the chest-expander can be separately used for exercising the muscles of the chest. According to still another aspect of the present invention, the rod members can be respectively fastened to the handles of the chest-expander to secure the bag and the wheels to the handles of the chest-expander so that the bag can be put with the pad on the floor to support the user's knees on the floor, and the user can lay the knees on the bag on the floor and then operate the distal rod member with the hands to move the wheels back and forth on the floor.

DETAILED DESCRIPTION OF THE PREFERRED EMBODIMENT

Figure 1:
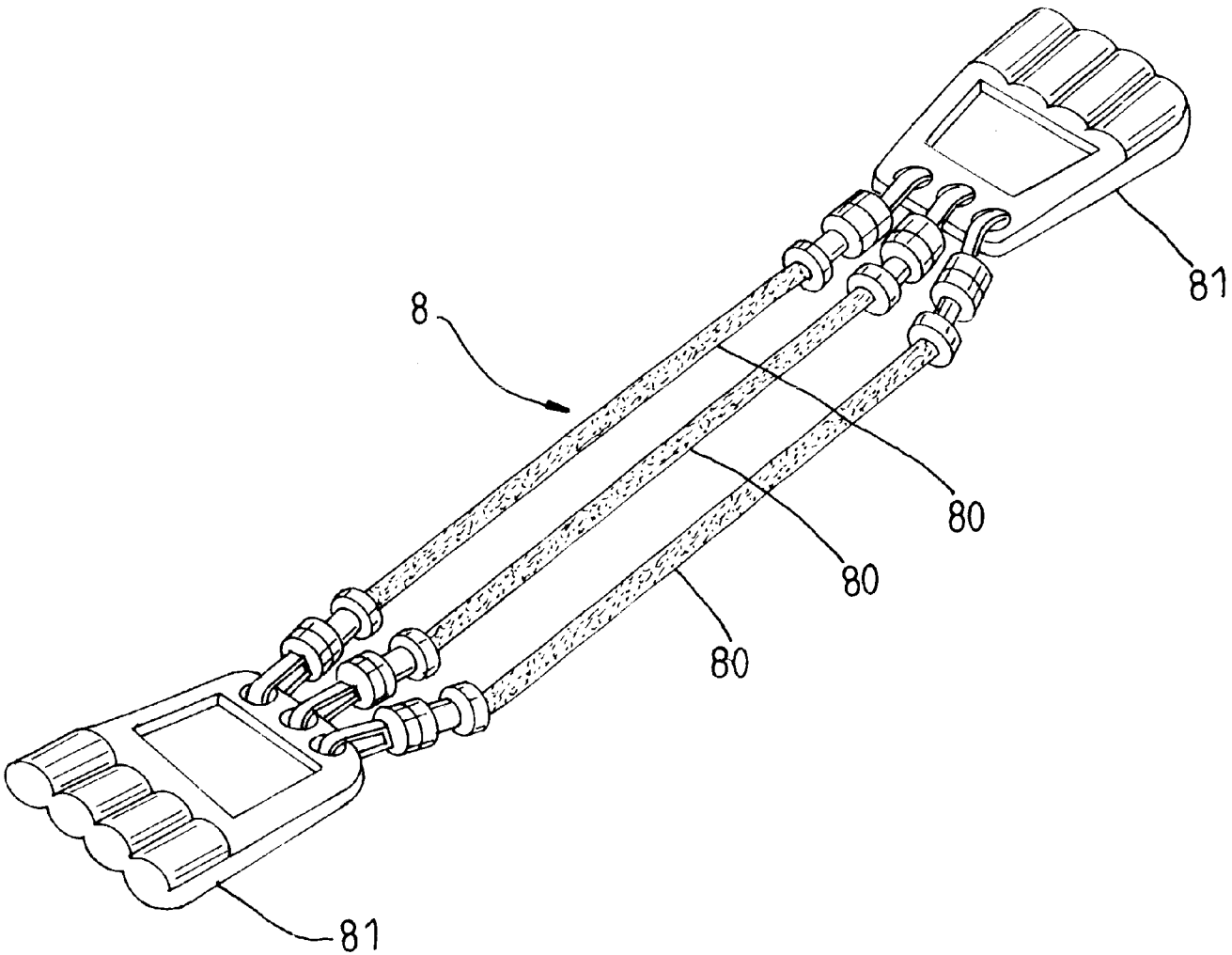
Fig. 1 PRIOR ART
FIG. 1 is a perspective view of a conventional chest-expander.

Referring to Figures from 2 through 15, a portable exercising apparatus in accordance with the present invention is generally comprised of a bag 1, a first rod member 2, a chest-expander 3, a second rod member 4, two wheels 5, and a pad 6.

Figure 2:
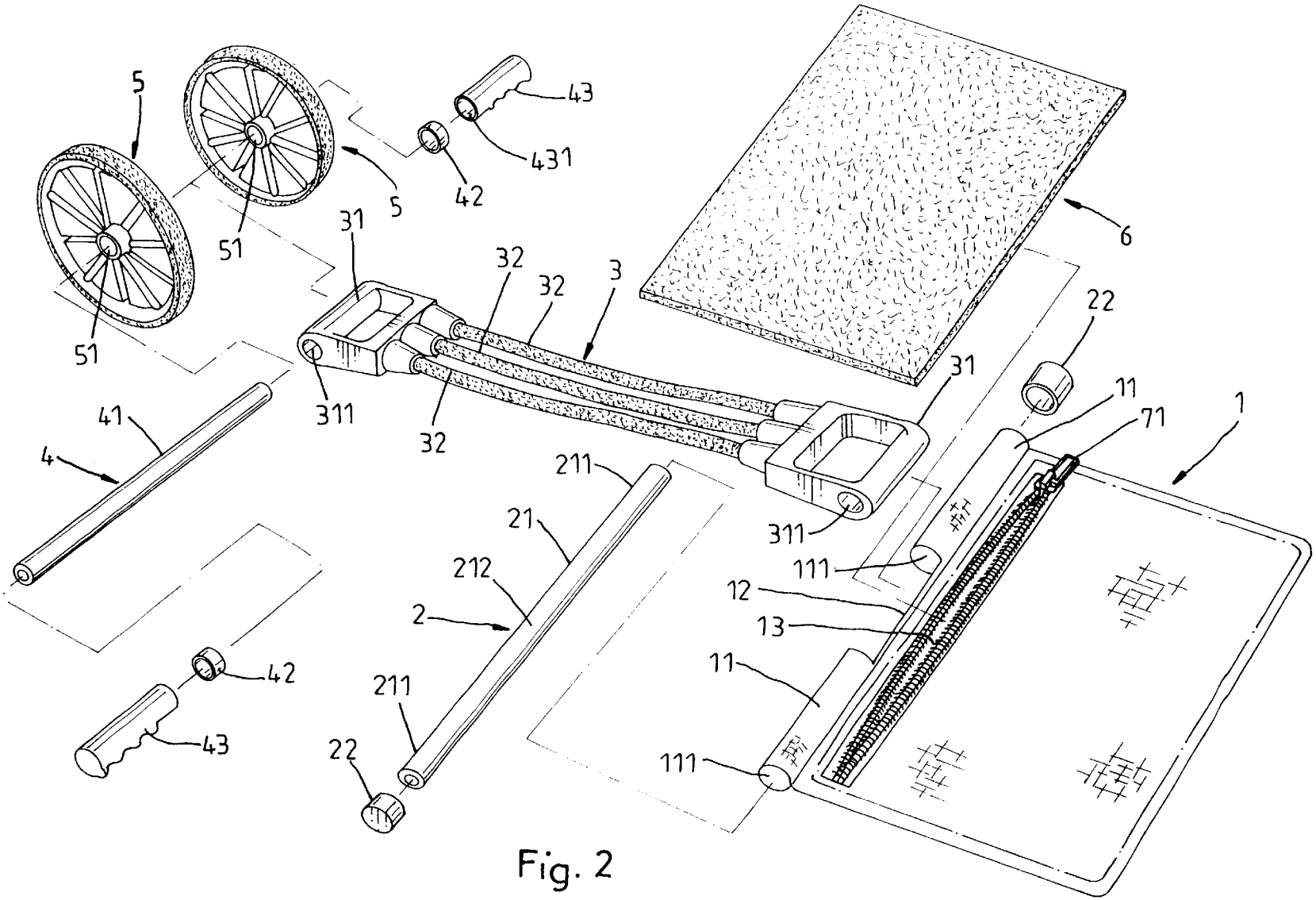
FIG. 2 is an exploded view of a portable exercising apparatus according to the present invention.
Figure 3:
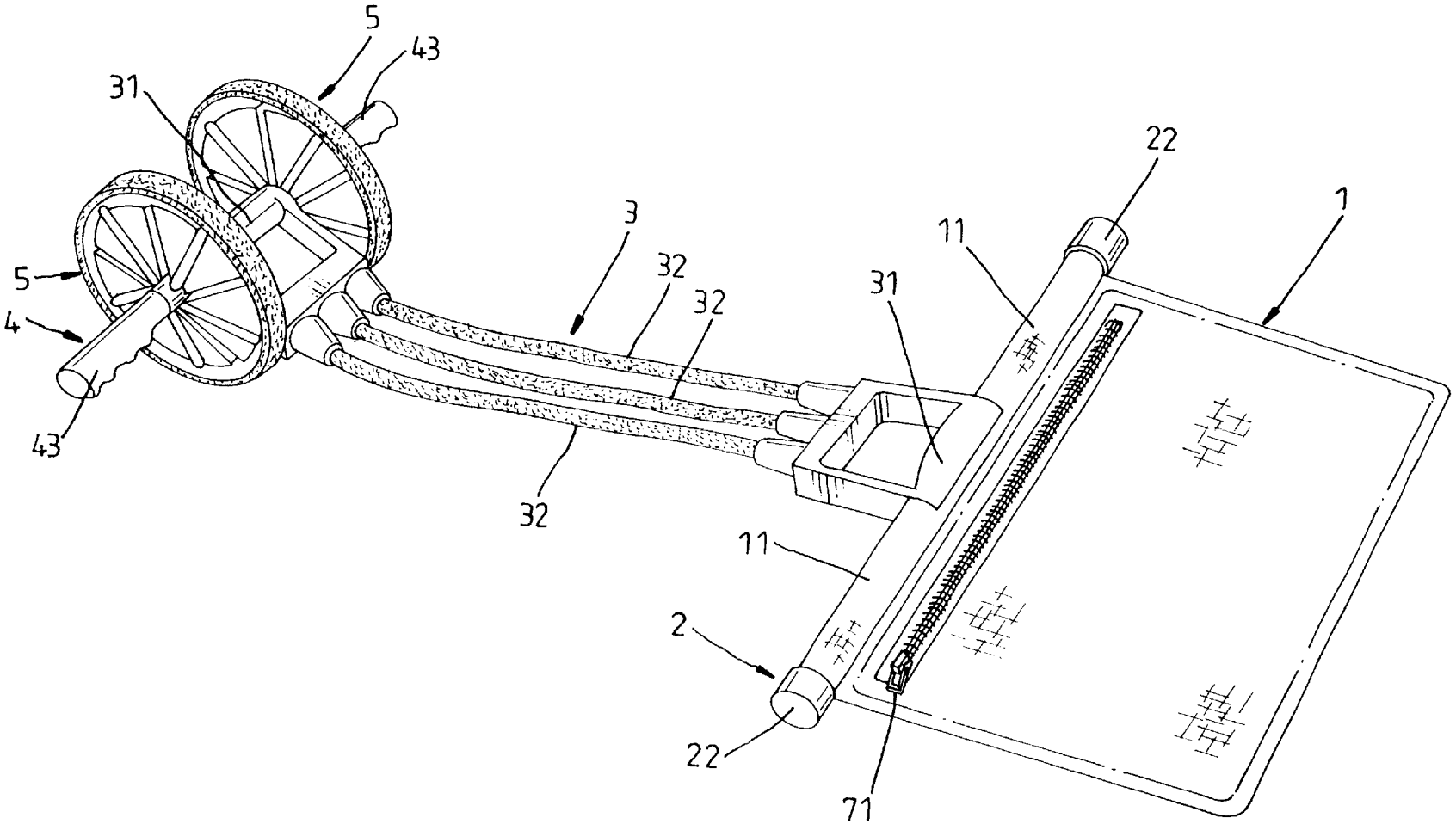
FIG. 3 is a perspective assembly view of the portable exercising apparatus according to the present invention.
Figure 14:
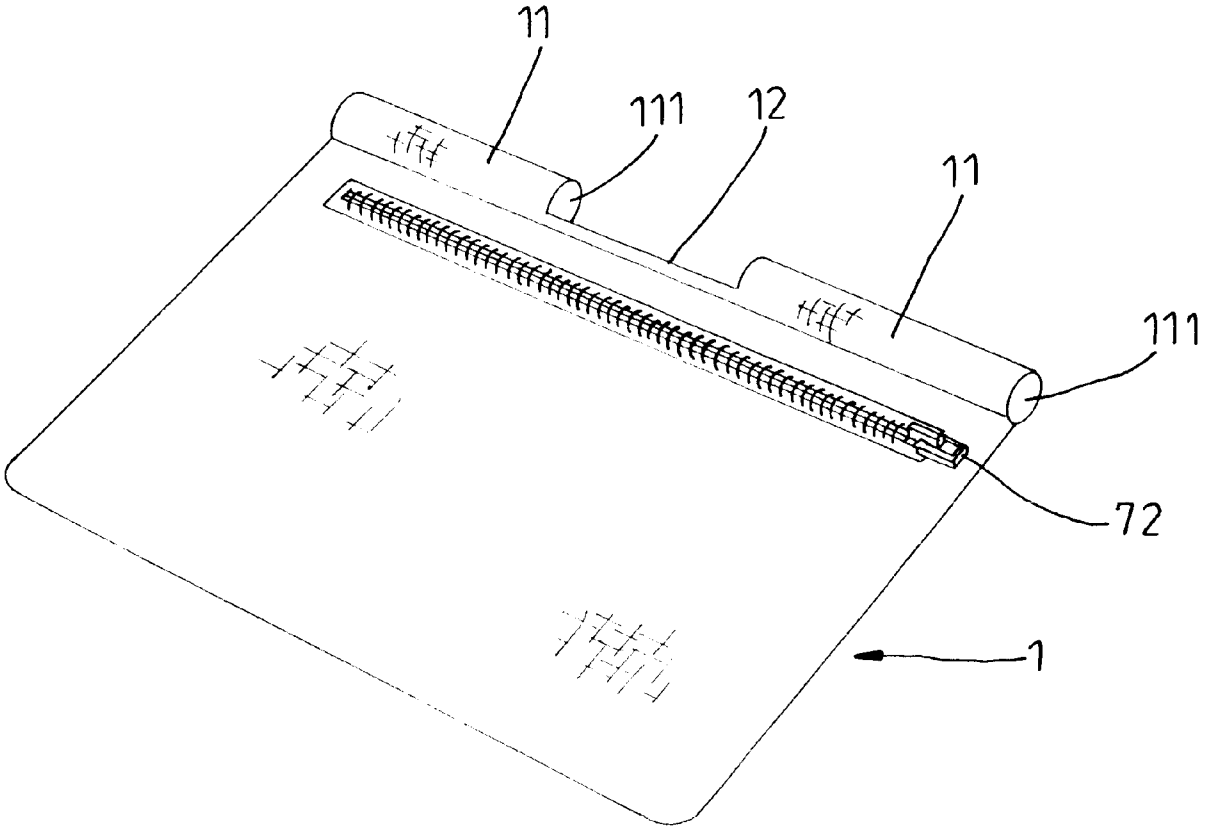
FIG. 14 is another view of FIG. 12.

The bag 1 comprises a first compartment 13 at one side adapted for receiving the pad 6, a first zipper 71 operated to close/open the first compartment 13 (see FIGS. 2 and 15), a second compartment 14 at an opposite side adapted for receiving the chest-expander 3, the second rod member 4 and the wheels 5 when the portable exercising apparatus is not in use, a second zipper 72 operated to close/open the second compartment 14 (see FIGS. 14 and 15), and two barrels 11 integral with one peripheral side thereof and spaced by a gap 12 (see FIG. 2). The barrels 11 are longitudinally aligned, each defining an axial through hole 111.

The chest-expander 3 comprises two handles 31, and a plurality of elastic cord members 32 connected between the handles 31. The handles 31 each have a transversely extended axle hole 311. The transverse width of the handles 31 is approximately equal to the gap 12 between the barrels 11 (see FIG. 2).

The first rod member 2 comprises a rod body 21 inserted through the axial through hole 111 on each barrel 11 of the bag 1 and the axle hole 311 on one handle 31 of the chest-expander 3, and two end caps 22 respectively fastened to the two distal ends 211 of the rod body 21 of the first rod member 2 to secure the bag 1, the first rod member 2 and the chest-expander 3 together (see FIG. 2).

The second rod member 4 comprises a rod body 41 inserted through the axial through hole 311 on one handle 31 of the chest-expander 3 and the center wheel axle hole 51 of each wheel 5, two bushings 42 respectively mounted within the center wheel axle hole 51 of each wheel 5 around the rod body 41, and two handgrips 43 respectively fastened to distal ends of the rod body 41 to secure the chest-expander 3, the second rod member 4 and the wheels 5 together, enabling the wheels 5 to be rotated on the rod member 41 between the handgrips 43 and the corresponding handle 31 of the chest-expander 3. The handgrips 43 each have an axially extended coupling hole 431 into which one end of the rod member 43 is press-fitted.

Figure 4:
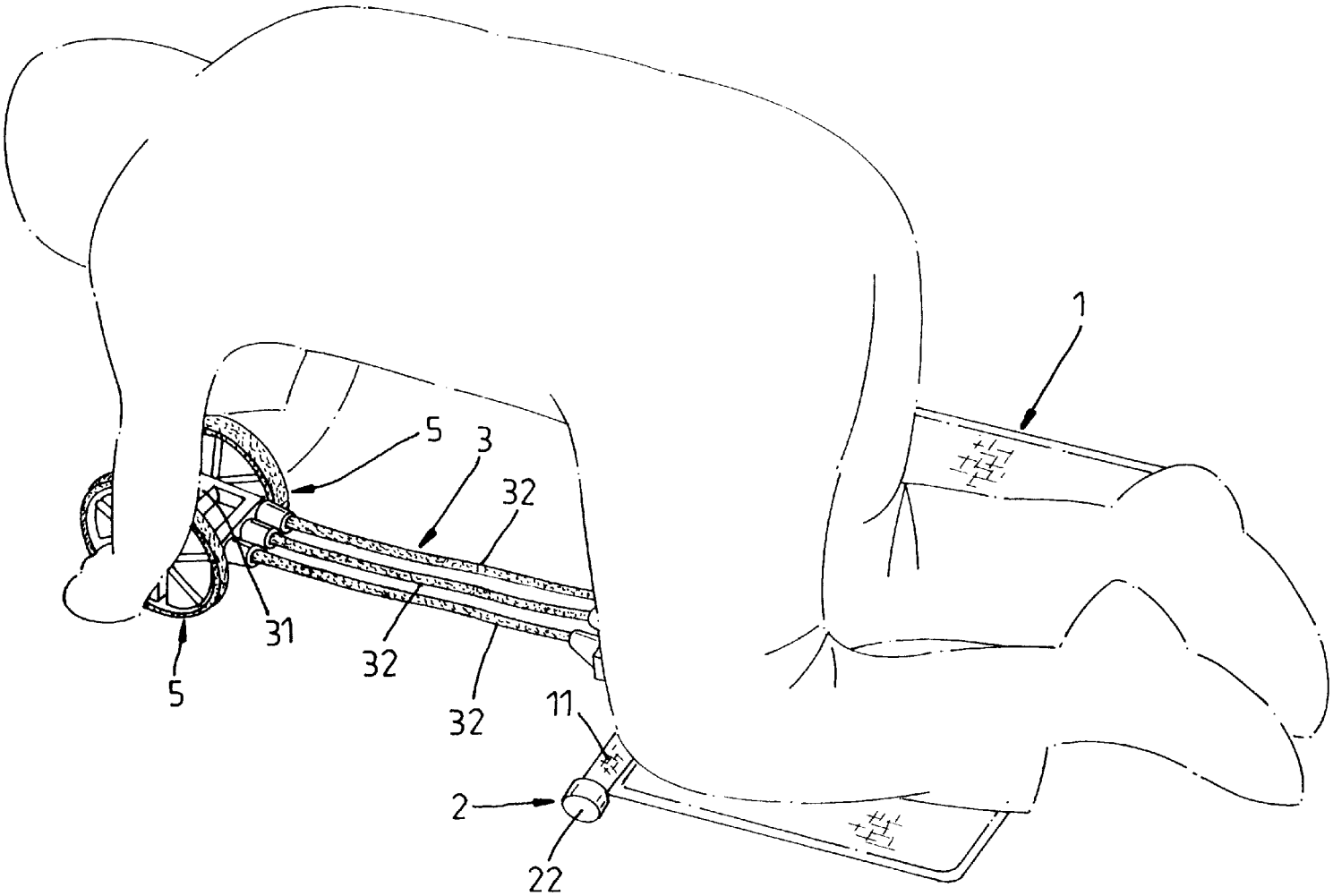
FIG. 4 shows one application example of the portable exercising apparatus according to the present invention.
Figure 5:
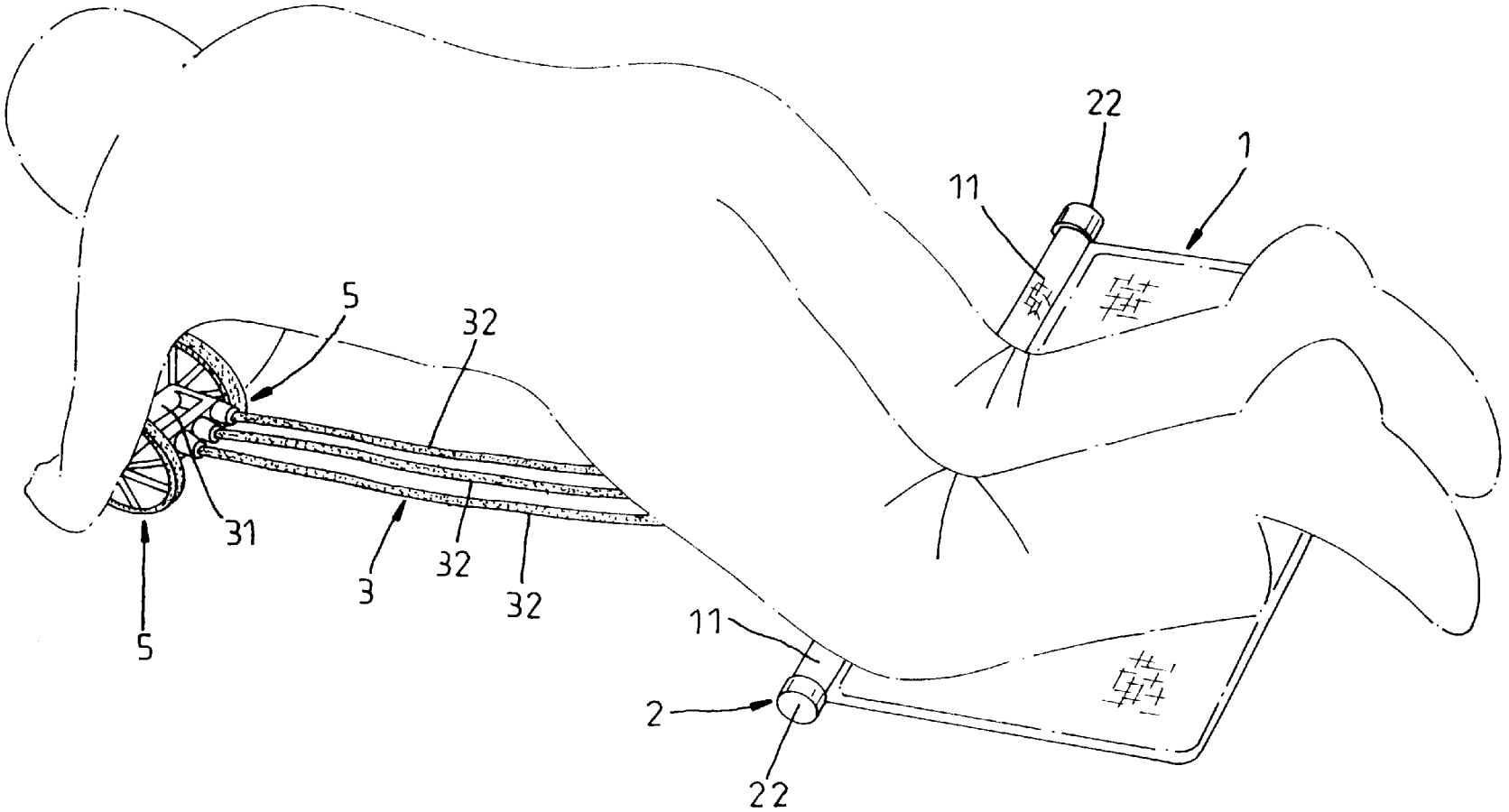
FIG. 5 is similar to FIG. 4 but showing the wheels pushed forwards.

The portable exercising apparatus can be used in different forms for different exercising purposes. FIGS. 4 and 5 show one application example of the present invention in which the user laid the knees on the bag 1 at the floor with the hands grasping the handgrips 43 to move the wheels 5 back and forth.

Figure 6:
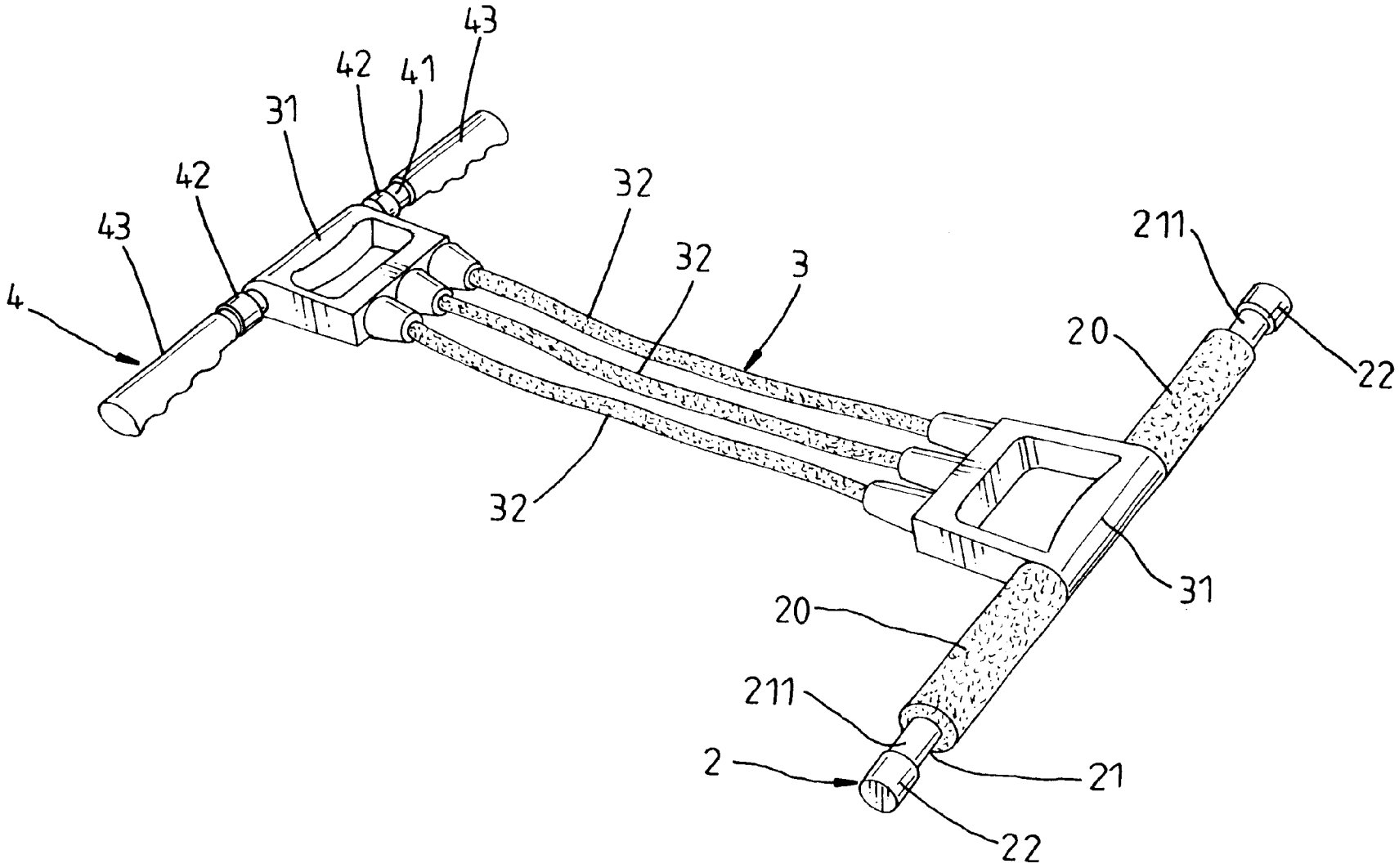
FIG. 6 shows the portable exercising apparatus arranged in a second form according to the present invention.
Figure 7:
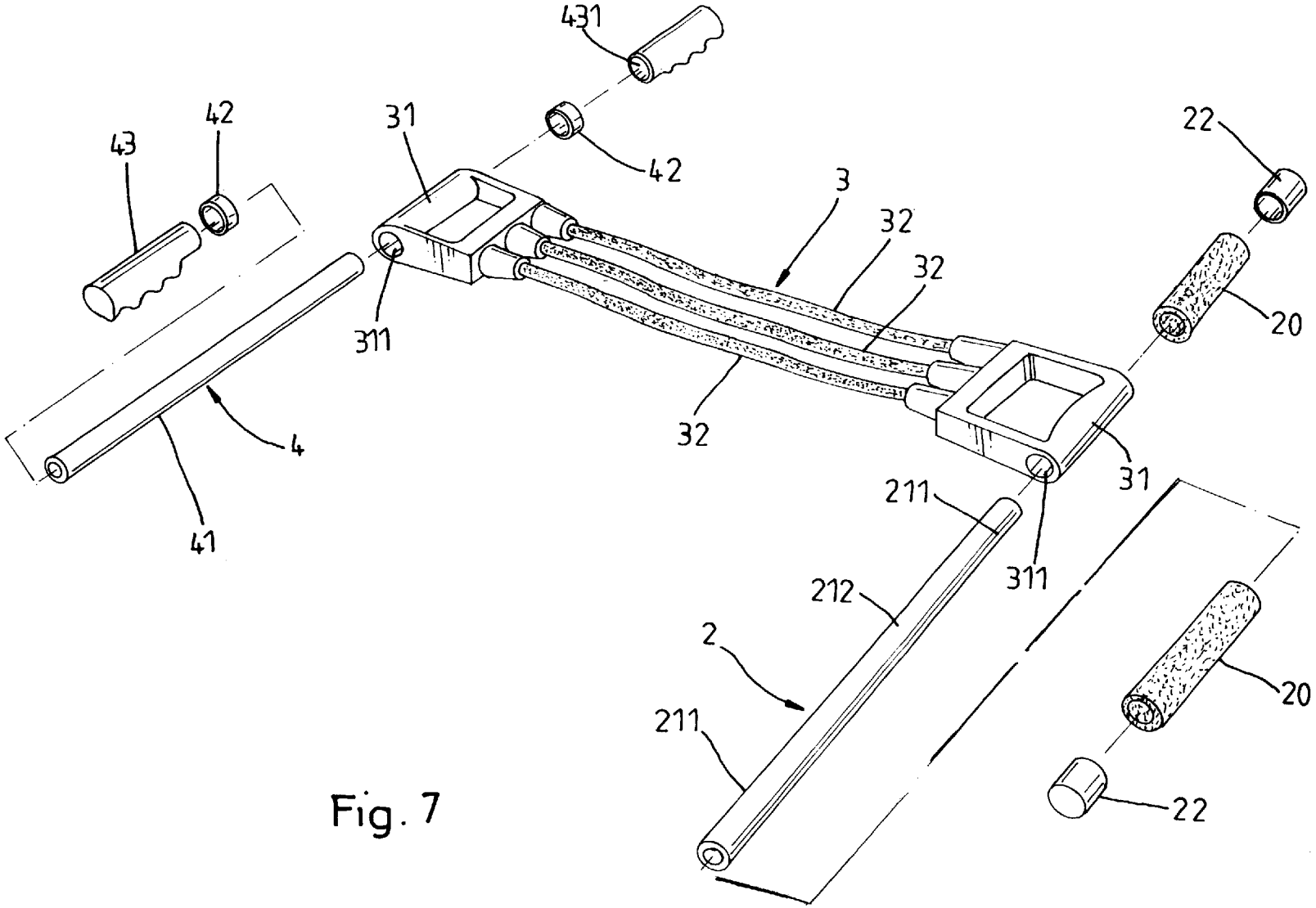
FIG. 7 is an exploded view of the assembly of FIG. 6.

FIGS. 6 and 7 show the present invention arranged in a second form, in which the bag 1 and the wheels 5 are not used; the first rod member 2 and the second rod member 4 are directly fastened to the handles 31 of the chest-espander 3, and two soft coverings 20 are fastened to the rod body 21 of the first rod member 2 and disposed at two opposite sides of the corresponding handle 31.

Figure 8:
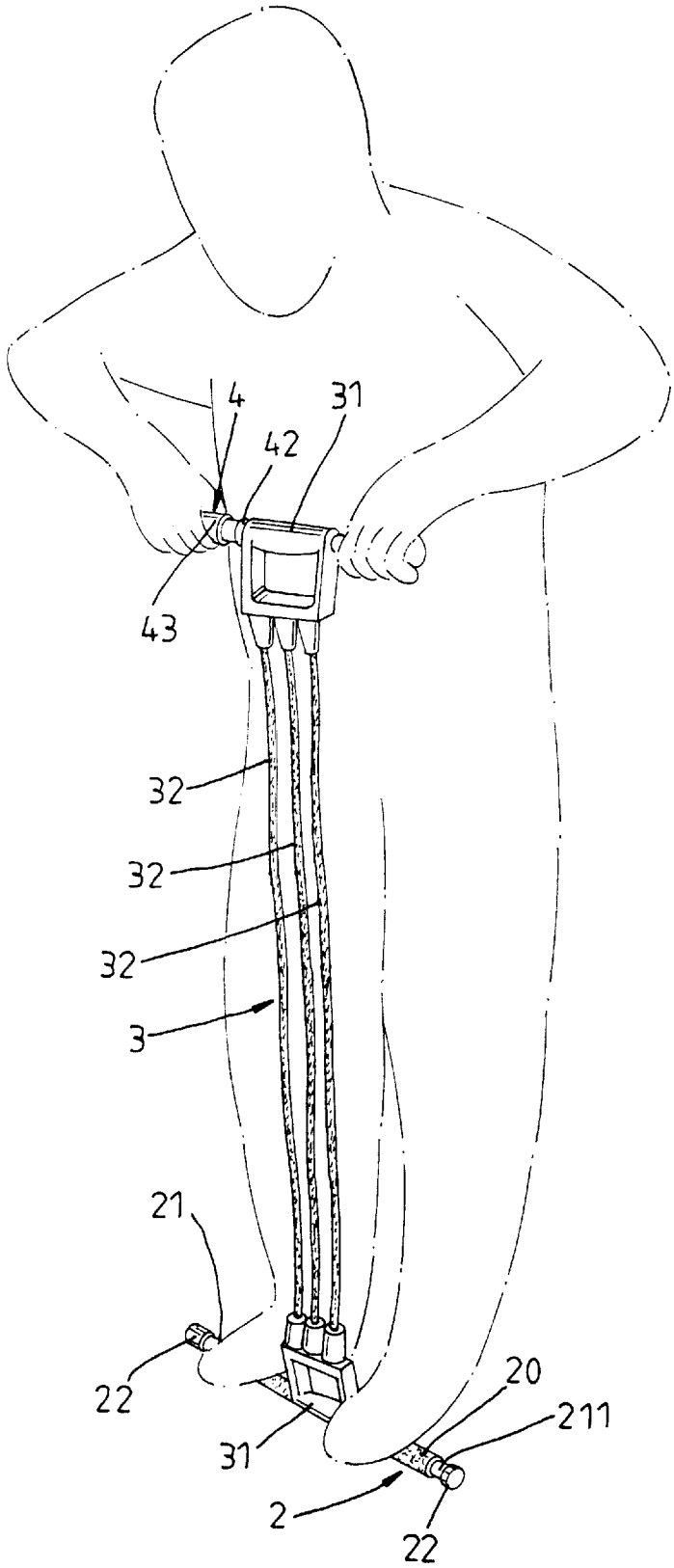
FIG. 8 shows one application example of the second form of the present invention.
Figure 9:
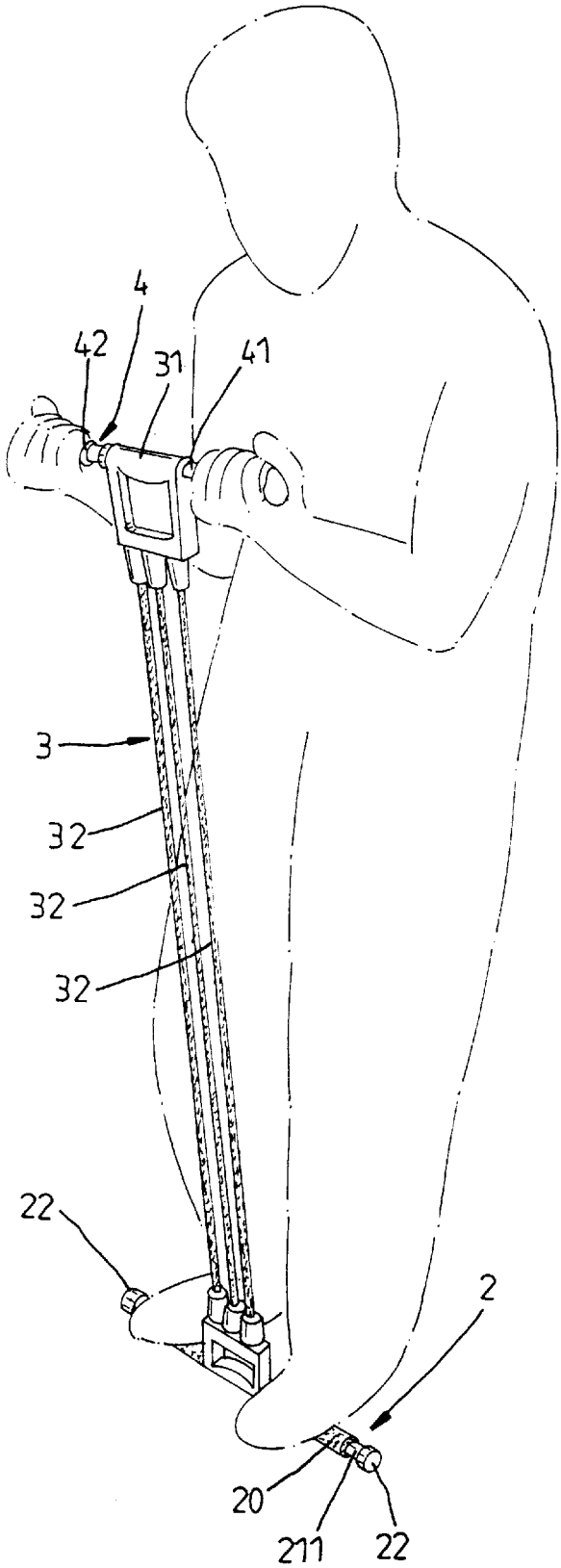
FIG. 9 is similar to FIG. 8 but showing an upward holding posture of the hands on the handgrips of the second rod mbmer.

FIGS. 8 and 9 show an application example of the second form of the present invention. According to this exercising example, the user grasps the handgrips 43 with the hands, and then pulls the second rod member 4 upwards while pressing the feet on the soft coverings 20 to hold down the first rod member 2 on the floor.

Figure 10:
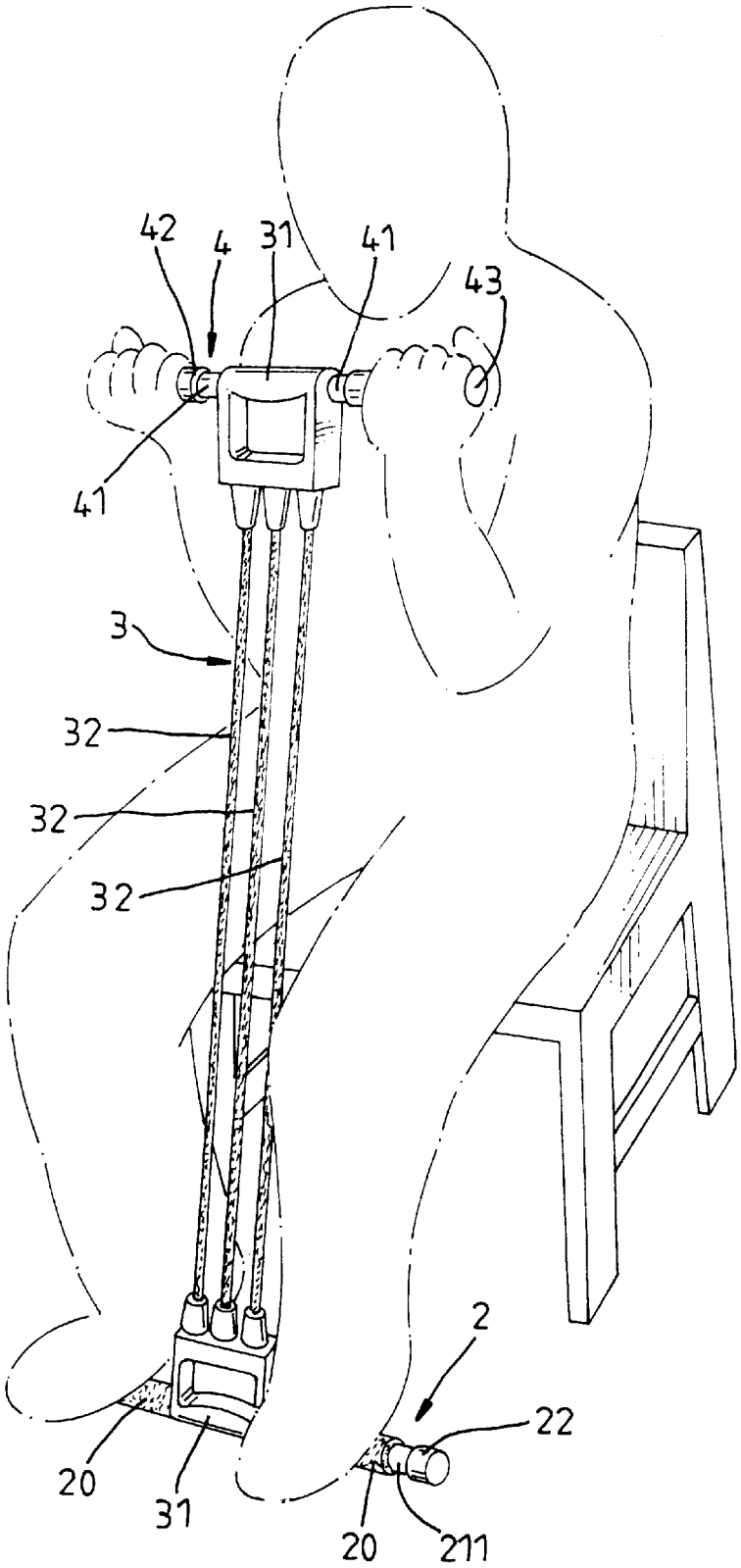
FIG. 10 shows another application example of the second form of the present invention.
Figure 11:
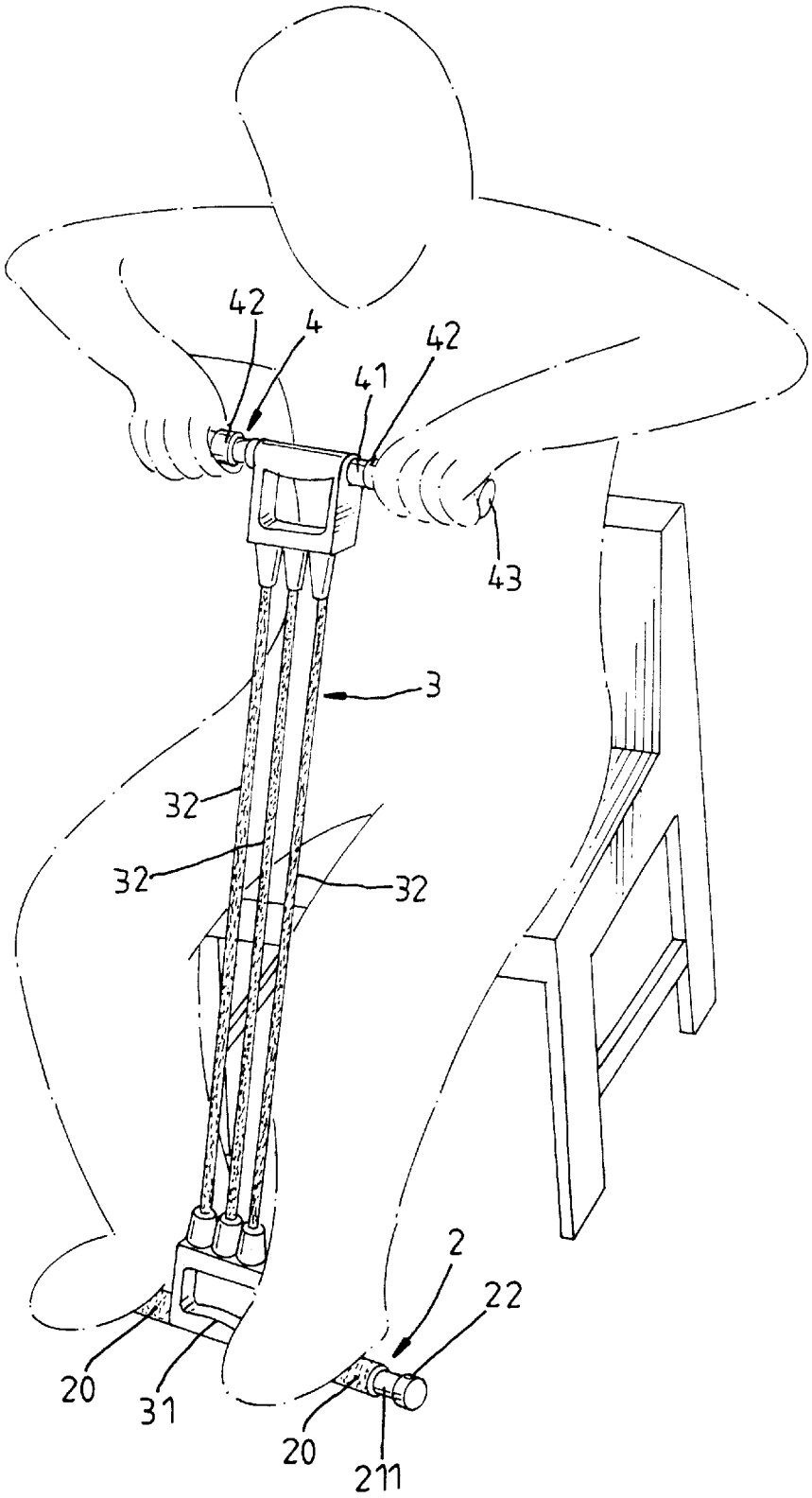
FIG. 11 is similar to FIG. 10 but showing a downward holding posture of the hands on the handgrips of the second rod member.
Figure 12:
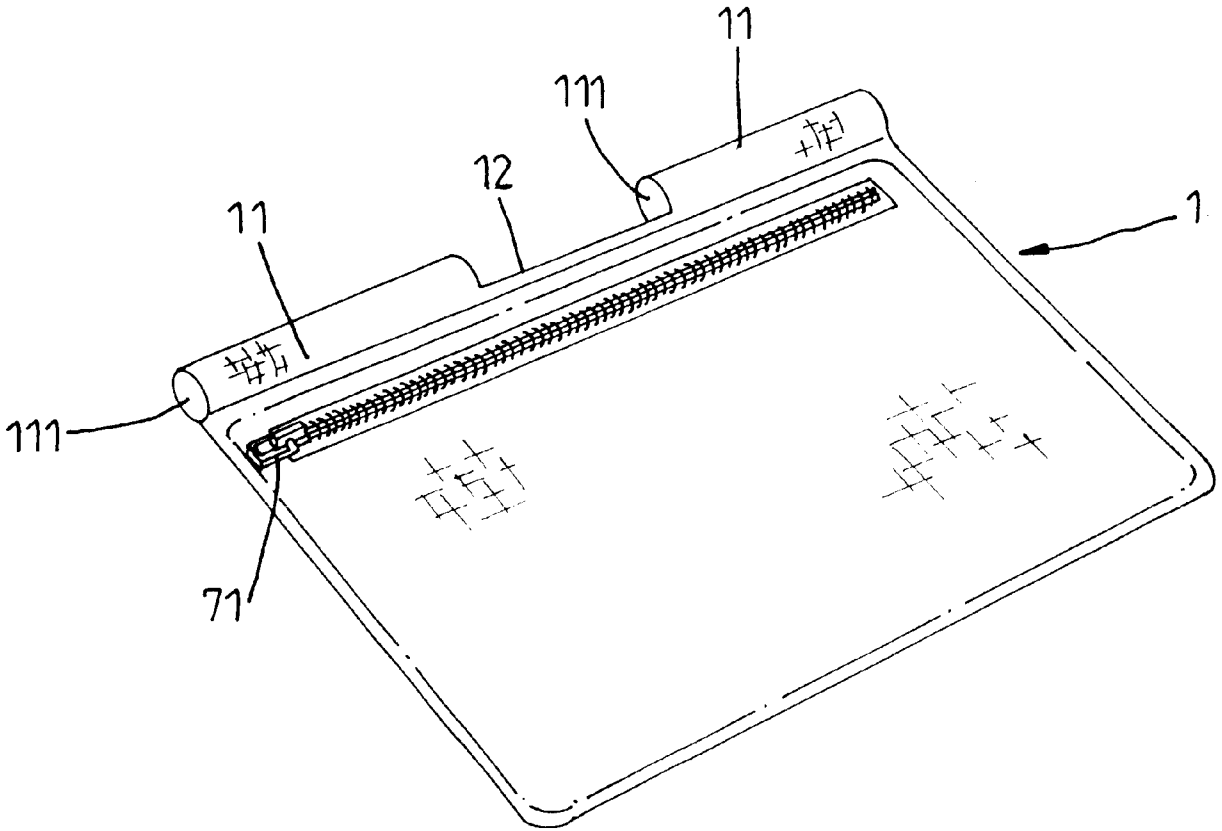
FIG. 12 is an oblique top side view of the bag for the portable exercising apparatus according to the present invention after installation of the pad in the first embodiment.

FIGS. 10 and 11 show another application example of the second form of the present invention. This exercising mode is similar to that shown in FIGS. 8 and 9 with the exception of sitting on a chair when exercising.

Figure 13:
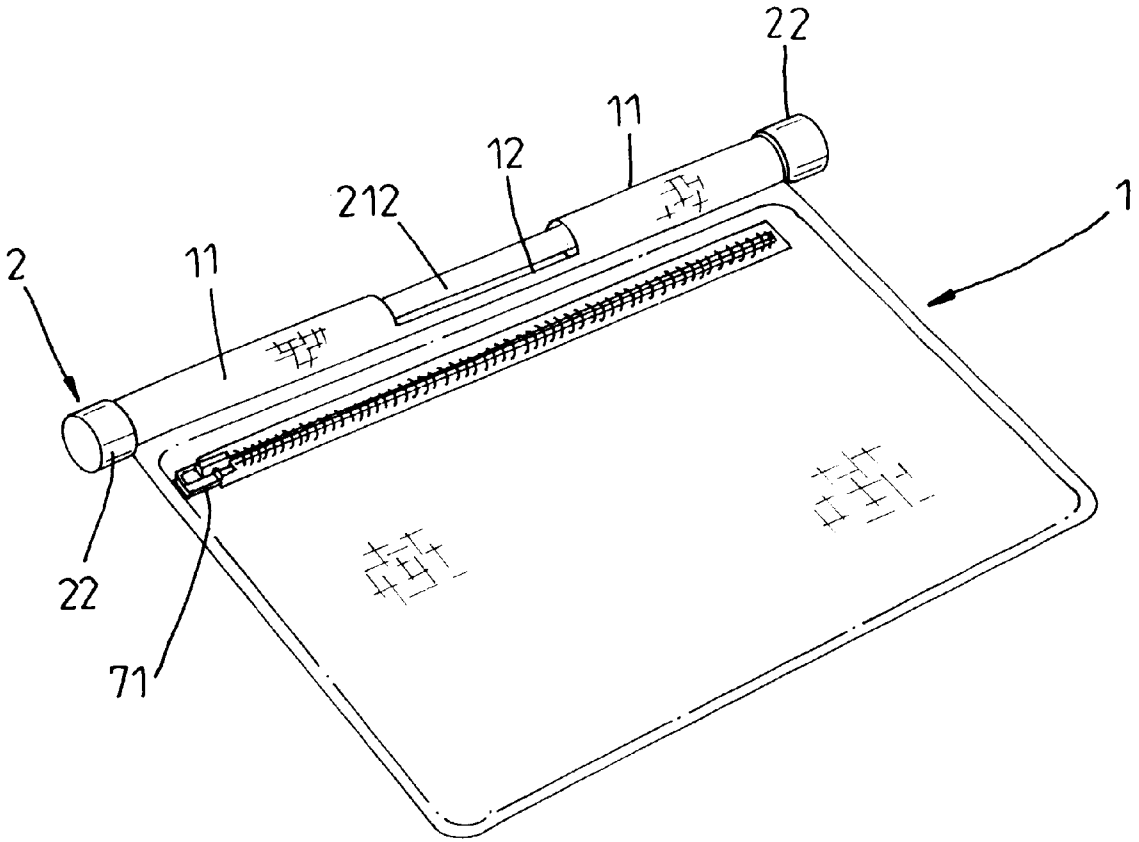
FIG. 13 is similar to FIG. 12 but showing the first rod member fastened to the barrels of the bag.
Figure 15:
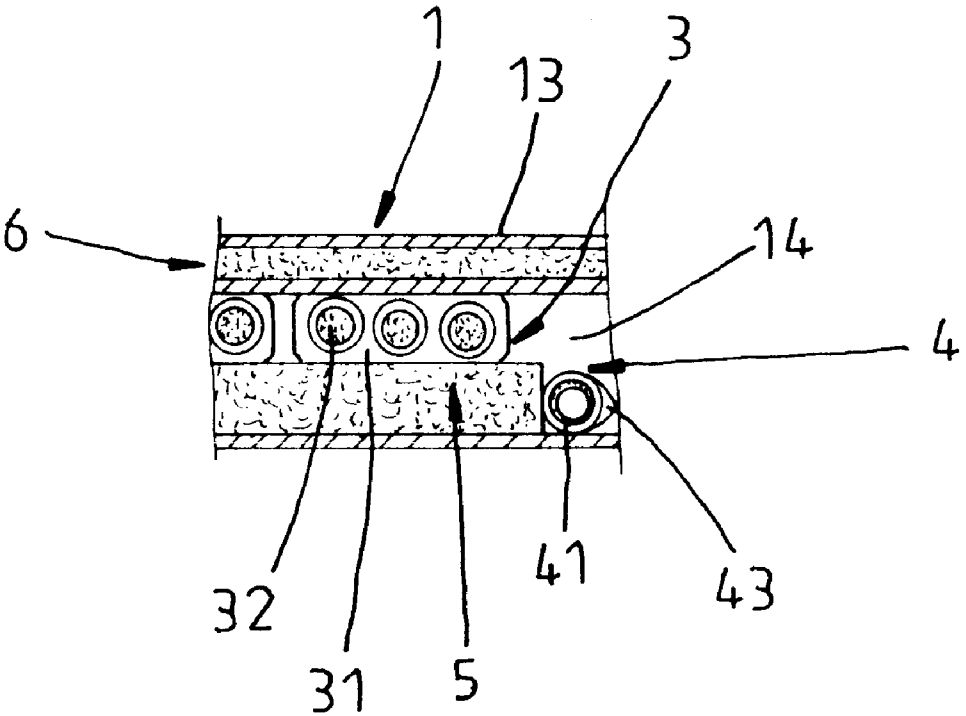
FIG. 15 is an oblique bottom side view of the bag for the Portable exercising apparatus according to the present invention after installation of the pad in the first compartment.

Referring to FIGS. 13 and 15, when not in use, the chest-expander 3, the second rod member 4 and the wheels 5 are received in the second compartment 14 of the bag 1, and the first rod member 2 is fastened to the barrels 11 of the bag 1 with the middle part 212 of the rod body 21 of the first rod member 2 suspended in the gap 12 between the barels 11 for carrying by hand.

What is claimed is:

1. A portable exercising apparatus comprising:

a chest-expander, said chest-expander comprising two handles, and a plurality of elastic cord members connected between said handles, said handles each having a transversely extended axle hole, a bag, said bag comprising a first compartment at one side, which receives a pad, a first zipper operated to close/open said first compartment, a second compartment at an opposite side adapted for keeping parts of the portable exercising apparatus when the portable exercising apparatus is not in use, a second zipper operated to close/open said second compartment, and two barrels integral with one peripheral side thereof and axially aligned in a line and spaced by a gap, which is greater than the width of the handles of said chest-expander;

a first rod member adapted for fastening to the barrels of said bag to serve as a carrying handle or to secure one handle of said chest-expander to said bag, said first rod member comprising a rod body adapted for inserting through an axial through hole on each barrel of said bag and/or the axle hole on one handle of said chest-expander, and two end caps adapted for fastening to two distal ends of the rod body of said first rod member to secure said first rod member to said bag and/or said chest-expander;

a second rod member adapted for fastening to one handle of said chest-expander to serve as handle means, said second rod member comprising a rod body adapted for inserting through the axial through hole on one handle of said chest-expander, and two handgrips adapted for fastening to distal ends of the rod body of said second rod member to secure said second rod member to said chest-expander; and two wheels adapted for mounting on the rod body of said second rod member between the handgrips of said second rod member and two opposite lateral sides of one handle of said chest-expander, said wheels each having a center wheel axle hole, which receives a respective bushing adapted to hold the rod body of said second rod member.

* * * * *